US006145602A

United States Patent [19]

Kutinsky

[11] Patent Number: 6,145,602

[45] Date of Patent: Nov. 14, 2000

[54] DOWNHOLE TOOL CATCHER AND METHOD

[75] Inventor: David Kutinsky, Edmonton, Canada

[73] Assignee: Canadian Downhole Drill Systems Inc., Nisku, Canada

[21] Appl. No.: 09/262,924

[22] Filed: Mar. 5, 1999

[51] Int. Cl.[7] ..... E21B 31/00; E21B 4/02

[52] U.S. Cl. ..... 175/107; 166/209; 175/320

[58] Field of Search ..... 166/98, 206, 209, 166/53, 301, 348; 175/92, 101, 107, 320

[56] References Cited

U.S. PATENT DOCUMENTS 4,577,687 3/1986 Lanmon .
4,681,168 7/1987 Kisling .
5,165,492 11/1992 Beasley ..... 175/107

*Primary Examiner*—Roger Schoeppel

*Attorney, Agent, or Firm*—Anthony R. Lambert

[57] ABSTRACT

A downhole tool catcher which includes a bottom hole assembly formed of an inner tubular in an outer tubular, an external housing connected to the outer tubular, and a washpipe extending from the inner tubular into the external housing, the washpipe having an external shoulder located uphole of an internal shoulder on the external housing, the external shoulder and internal shoulder being configured to engage each other upon movement of the external housing in an uphole direction in relation to the washpipe. In a preferred embodiment of the invention, the bottom hole assembly includes a mud motor. According to a method of the invention, the bottom hole assembly is installed downhole at the end of a tubing string that includes the external housing, with the washpipe in the external housing, and upon failure of a joint between the outer tubular and external housing, lifting the bottom hole assembly by pulling on the external housing and engaging the external shoulder on the washpipe with the internal shoulder on the external housing.

3 Claims, 1 Drawing Sheet

DOWNHOLE TOOL CATCHER AND METHOD

FIELD OF THE INVENTION

This invention relates to a tool catcher of use with downhole tools, particularly a bottom hole assembly.

BACKGROUND OF THE INVENTION

In downhole tools it is common to have a bottom hole assembly that has inner and outer tubulars of which only the outer tubular is connected by a joint to a tubular (referred to herein as an external housing) in the tubing string above the bottom hole assembly. If the joint fails, the entire bottom hole assembly may be lost downhole. To recover the bottom hole assembly, an expensive and potentially unsuccessful fishing expedition may be required. The invention addresses this problem.

SUMMARY OF THE INVENTION

There is therefore provided in accordance with an apparatus of the invention, a downhole tool catcher which comprises a bottom hole assembly formed of an inner tubular in an outer tubular, an external housing connected to the outer tubular, and a washpipe extending from the inner tubular into the external housing, the washpipe having an external shoulder located uphole of an internal shoulder on the external housing, the external shoulder and internal shoulder being configured to engage each other upon movement of the external housing in an uphole direction in relation to the washpipe. In a preferred embodiment of the invention, the bottom hole assembly includes a mud motor.

According to a method of the invention, the bottom hole assembly is installed downhole at the end of a tubing string that includes the external housing, with the washpipe in the external housing, and upon failure of a joint between the outer tubular and external housing, lifting the bottom hole assembly by pulling on the external housing and engaging the external shoulder on the washpipe with the internal shoulder on the external housing.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

A tubular is a device used downhole in wells typically with connections at either end for connection to other tubulars. A reference to a connection or devices connected together is a reference to various known ways of connecting tubulars, as for example conventional box and pin connections.

Figure 1:
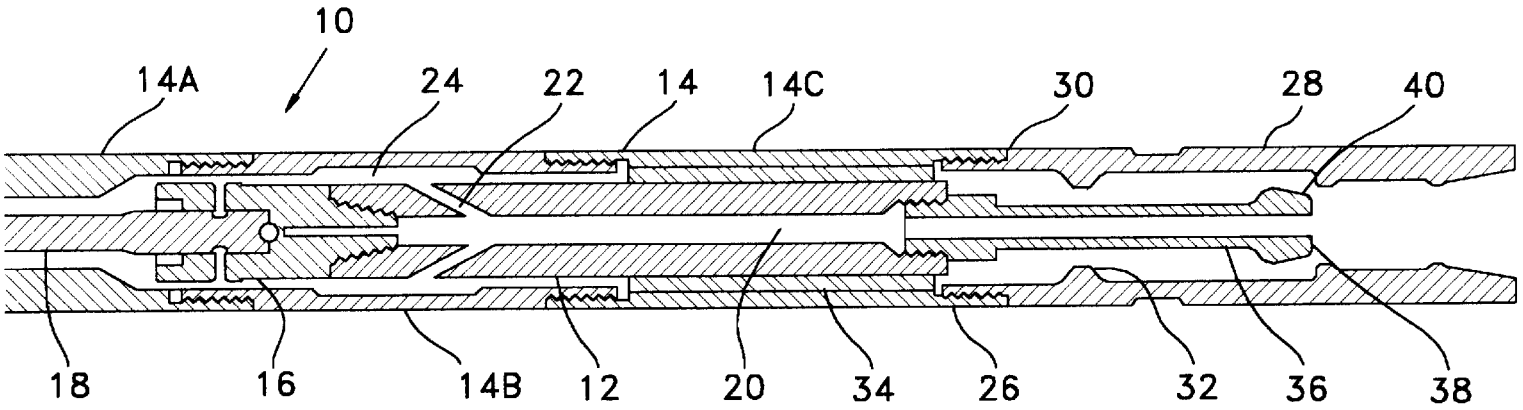
FIG. 1 shows a tool catcher and bottom hole assembly according to the invention in which the bottom hole assembly is secured to the tubing string.
Figure 2:
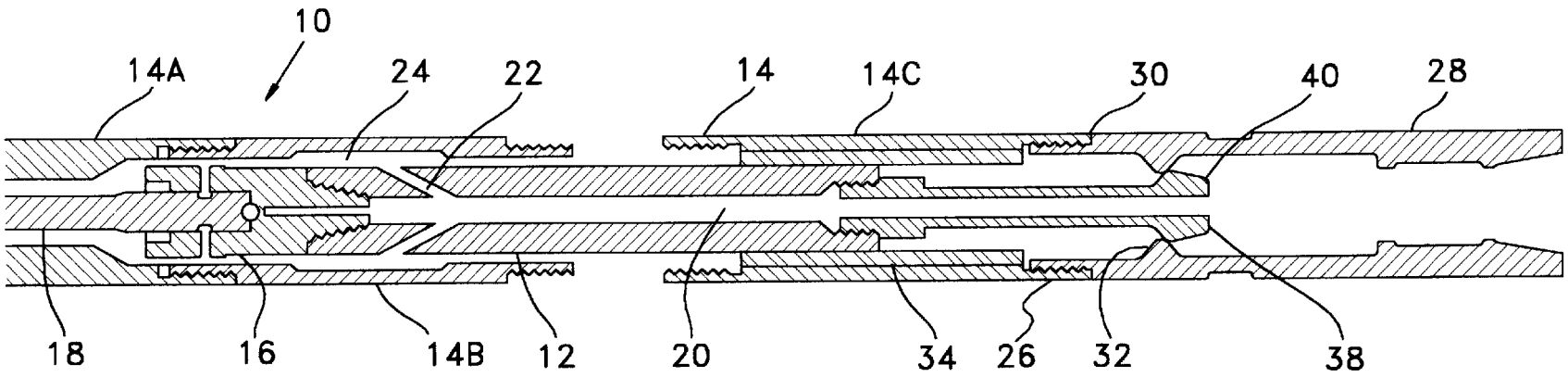
FIG. 2 shows the tool catcher and bottom hole assembly of FIG. 1 in which the bottom hole assembly has separated from the tubing string.

Referring to FIG. 1, there is shown a bottom hole assembly 10 formed of an inner tubular 12 located inside an outer tubular 14. In this case, the inner tubular 12 is connected downhole via a universal joint 16 to a drive shaft 18 of a mud motor (not shown). When the mud motor is in operation fluid is driven down the bore 20 of the inner tubular 12 through passages 22 into annulus 24 formed between the inner tubular 12 and outer tubular 14. Further downhole in a portion not shown, the mud drives the mud motor. The outer tubular 14 is formed of three subs 14A, 14B and 14C threaded together and terminating in the uphole direction in an uphole end 26.

An external housing 28 is connected by a joint 30, typically a threaded joint as shown, to the uphole end 26 of the outer tubular 14. The external housing 28 is provided with an inner shoulder 32, which may be continuous or discontinuous but which preferably extends continuously around the inside perimeter of the external housing 28 at a point sufficiently spaced from the uphole end 34 of the inner tubular 12 that when the components are secured together, the shoulder 32 is uphole of the uphole end 34 of the inner tubular 12.

An internal washpipe 36 is connected, typically by a conventional threaded joint, to the inner tubular 12. The internal washpipe 36 has an upper portion 38 extending into the external housing 28 beyond (further uphole than) the inner shoulder 32. The internal washpipe 36 has an outer shoulder 40 on the upper portion 38 of the internal washpipe 36. The outer shoulder 40 may be continuous or discontinuous but preferably extends continuously around the outer perimeter of the upper portion 38. If both the inner shoulder 32 and the outer shoulder 40 are continuous, and the bore defined by the inner shoulder 32 is smaller than the outer perimeter of the outer shoulder 40, then this configuration ensures that the shoulders 32, 40 engage each other upon separation of the outer tubular and the external housing, and permit lifting of the bottom hole assembly by pulling up on the external housing 28. The external housing 28 is normally connected as part of a tubing string.

In operation, if the connection between the outer tubular 14 and the external housing 28 fails, the drilling personnel will be able to detect a pressure loss, and the drilling operation may be stopped. When the well site personnel attempt to remove the drill string from the well bore, the internal shoulder 32 on the external housing 28 comes in contact with the external shoulder 40 on the washpipe 36. This will in turn lift the inner tubular of the bottom hole assembly. Due to interference of internal components with the outer portion of the bottom hole assembly, the complete bottom hole assembly may be removed from the well bore.

Immaterial modifications may be made to the invention described here without departing from the essence of the invention.

The embodiments of the invention in which an exclusive property or privilege is claimed are defined as follows:

1. A downhole tool catcher, comprising:

a bottom hole assembly having an inner tubular located in an outer tubular, the outer tubular having an uphole end;

an external housing connected by a joint to the uphole end of the outer tubular, the external housing having an inner shoulder;

an internal washpipe connected to the inner tubular, the internal washpipe having an upper portion extending into the external housing beyond the inner shoulder; and the internal washpipe having an outer shoulder on the upper portion of the internal washpipe, the inner shoulder and the outer shoulder being configured to engage each other upon separation of the outer tubular and the external housing.

2. The downhole tool catcher of claim 1 in which the bottom hole assembly comprises a mud motor.

3. A method of catching components of a downhole tool, the method comprising the steps of:

installing a bottom hole assembly in a well, wherein the bottom hole assembly comprises an inner tubular in an outer tubular, an external housing connected to the outer tubular, and a washpipe extending from the inner tubular into the external housing, the washpipe having an external shoulder located uphole of an internal shoulder on the external housing, the external shoulder and internal shoulder being configured to engage each other upon movement of the external housing in an uphole direction in relation to the washpipe; and upon failure of a joint between the outer tubular and external housing, lifting the bottom hole assembly by pulling on the external housing and engaging the external shoulder on the washpipe with the internal shoulder on the external housing.

* * * * *